United States Patent [19]

Keasler

[11] 4,000,668

[45] Jan. 4, 1977

[54] BLIND BOLT FASTENER INSTALLATION TOOL WITH AN APPARATUS FOR RETRIEVING SEVERED BLIND BOLT FASTENER STEMS

[76] Inventor: Ben C. Keasler, 864 W. 16th St., Newport Beach, Calif. 92660

[22] Filed: Nov. 3, 1975

[21] Appl. No.: 628,049

[52] U.S. Cl. ..... 81/55; 72/391

[51] Int. Cl.[2] ..... B25B 13/06

[58] Field of Search ..... 81/55, 56; 72/391, 114

[56] References Cited

UNITED STATES PATENTS

| | | | |
|---|---|---|---|
| 2,789,597 | 4/1957 | Torre | 81/55 |
| 3,028,777 | 4/1962 | Essex | 81/55 |
| 3,128,655 | 4/1964 | Keasler | 81/55 |
| 3,196,662 | 7/1965 | Simmons | 72/391 |
| 3,457,763 | 7/1969 | Freeman | 72/391 |
| 3,543,560 | 12/1970 | Harris | 72/391 |

*Primary Examiner*—C.W. Lanham
*Assistant Examiner*—Gene P. Crosby
*Attorney, Agent, or Firm*—Lyon & Lyon

[57] ABSTRACT

An improved blind bolt fastener installation tool with an apparatus for retrieving the stems of blind bolt fasteners, which are severed during the installation of such fasteners, by restraining each severed stem from falling from the installation tool until disengagement and direction into an enclosure for retaining severed stems.

6 Claims, 7 Drawing Figures

BLIND BOLT FASTENER INSTALLATION TOOL WITH AN APPARATUS FOR RETRIEVING SEVERED BLIND BOLT FASTENER STEMS

BACKGROUND OF THE INVENTION

This invention relates to a blind bolt fastener installation tool of the general class exemplified by the tools disclosed in U.S. Pat. No. 3,128,655, issued to Ben C. Keasler, entitled "Blind Bolt Installation Tool With Preloaded Torque-Responsive Driving Mechanism" and U.S. Pat. No. 2,789,597, issued to Joseph LaTorre, entitled "Driving And Setting Tool for Blind Fasteners". More particularly, it relates to an improved blind bolt fastener installation tool with an apparatus for retrieving blind bolt fastener stems which are severed during the installation of such fasteners. Still more particularly, it relates to an apparatus, which retrieves severed blind bolt fastener stems, for use in conjunction with a conventional blind bolt fastener installation tool.

Blind bolt fasteners are generally used to join sheets of work, such as metal sheets, in the fabrication of various products, such as airplanes. The fasteners are comprised of a screw portion, a nut portion and a collar portion. The screw portion has a generally circular head and a shaft, the shaft having external threads and wrenching flats. The end portion of the shaft is known as a break-off stem because it is severed from the shaft during the installation of the fastener, as will be explained below. The nut portion of the fastener usually has a section in the shape of a nut with a sleeve section extending therefrom, both the nut-shaped section and sleeve section having internal threads. The outside diameter of the sleeve section is approximately the same as the diameter of the head of the screw portion, and the width across the flats of the nut-shaped section is approximately twice the outside diameter of the sleeve section. The end of the sleeve section unattached to the nut-shaped section generally has a tapered end. The collar portion of the fastener is a hollow cylindrical piece having an outside diameter slightly less than or equal to the outside diameter of the head of the screw portion of the fastener and an inside diameter greater than the diameter of the shaft of the screw portion, the collar being constructed of a malleable metal.

A pre-installed blind bolt fastener has the shaft of its screw portion threaded through the sleeve and nut-shaped sections of its nut portion, with the shaft protruding a short distance through the nut-shaped section. The collar loosely fits around the shaft between the head of the screw portion and the tapered end of the sleeve section of the nut portion.

During the installation process, blind bolt fasteners are normally hand-loaded one at a time by the operator of the installation tool. They are loaded with the nut-shaped part of the nut portion being received and prevented from rotating by a cavity, called wrenching jaws herein, located at the forward end of the tool. The protruding part of the shaft passes through the wrenching jaws and is received by a rotating assembly having wrenching flats that mate with the flats of the shaft. The rotating assembly is located rearwardly of the wrenching jaws and adjacent thereto.

After the blind bolt fastener has been loaded in the foregoing manner, the operator places the part of the fastener projecting from the forward end of the installation tool through adjacent holds which have previously been drilled through the sheets of work to be joined. These holes are drilled with a diameter great enough to receive the head and collar portions of the fastener, as well as the shaft section of the nut portion, but with a diameter less than the width across the flats of the nut-shaped section of the nut portion. Also, a fastener is selected with a sleeve section of slightly greater length than the combined length of the adjacent holes in the work to be joined, such that when the operator gets the loaded fastener and tool in the ready position (i.e. with the nut-shaped section of the nut portion flush against the sheet of work nearest the tool), the head, collar and a short length of the shaft section extend beyond the sheet of work non-adjacent the tool.

When the operator has the fastener and tool in the aforementioned ready position, he starts the installation tool, causing the rotating assembly mentioned above and the protruding part of the shaft received by it to rotate in such a manner as to cause the shaft to be drawn rearwardly into the installation tool. This, of course, causes the head of the screw portion of the fastener to be drawn against the collar portion, with the collar, in turn, being forced over the tapered end of the sleeve section of the nut portion. The collar portion ultimately directly abuts the sheet of work non-adjacent the tool and is compressed and flattened such that the sheets of work are held securely between the nut-shaped section of the nut portion of the fastener and the flattened collar.

As the collar is compressed and flattened in the foregoing manner, a turning resistance in the shaft of the screw portion of the fastener builds up until the end portion, or break-off stem, of the shaft is twisted off and thereby severed from the fastener.

Conventional blind bolt installation tools are of a type which dispells the stem of a blind bolt fastener that is severed during the installation of the fastener. Normally, the severed stems are dispelled from the orifice into which the fastener is loaded prior to installation. Generally, this dispelling is facilitated by a spring, included within the rotating assembly mentioned above, which is contacted and compressed by the end portion of the fastener shaft as it is drawn into the tool during installation of the fastener. Hence, when the stem of the fastener is severed and the tool withdrawn from the fastened work, the severed stem is ejected from the tool by the expansion of the spring.

In practice, the severed blind bolt fastener stems dispelled from installation tools of the type referred to above are strewn around the working area of the operator of the installation tool to be cleaned up at some later time, unless they are manually collected by the operator, a process which is extremely time consuming. However, unless an operator carefully collects these severed stems, they create a potential safety hazard due to people stepping thereon and possibly slipping. Furthermore, they create another particularly acute problem in the airplane manufacturing industry, where blind bolt fasteners are used extensively for assembly purposes. During the assembly of airplanes, foreign matter of all types, particularly small metal pieces, such as severed blind bolt fastener stems, should be scrupulously collected by workers, such as operators of blind bolt fastener installation tools, due to the danger that they might ultimately become engaged in some vital part of an aircraft and cause a malfunction thereof. Hence, it would be highly advantageous to have a blind bolt installation tool with the facility for retrieving the severed stems of blind bolt fasteners before they are strewn about a particular working area.

It is an object of the present invention to provide an improved blind bolt fastener installation tool which is capable of retrieving the stems of blind bolt fasteners which are severed during the installation of such fasteners.

Another object of the present invention is to provide a method and an apparatus for retrieving severed blind bolt fastener stems which can be employed in conjunction with conventional type blind bolt fastener installation tools.

Still another object of the present invention is to provide for a simple and efficient means of retrieving severed blind bolt fastener stems normally ejected during operation of a blind bolt fastener installation tool.

Many other features, advantages and additional objects of the present invention will become manifest to those versed in the art upon making reference to the detailed description which follows and the accompanying sheets of drawings in which a preferred structural embodiment incorporating the principles of the present invention is shown by way of illustrative example only.

GENERAL DESCRIPTION

Figure 1:
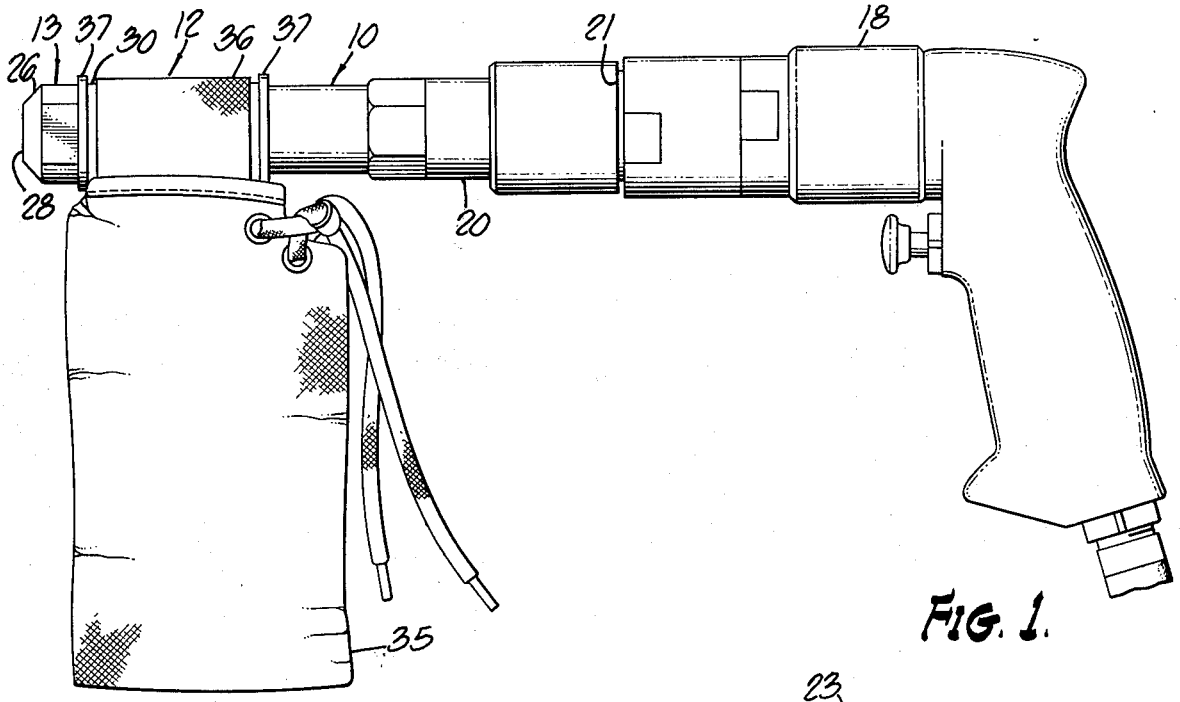
FIG. 1 is a side view of a blind bolt fastener installation tool having an apparatus for retrieving severed blind bolt fastener stems in accordance with the principles of the present invention.
Figure 4:
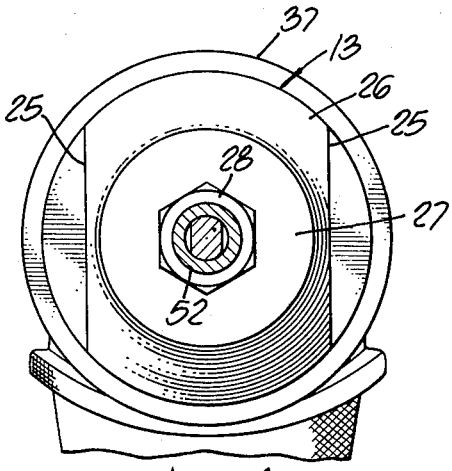
FIG. 4 is a cross-sectional view taken on the line 4—4 of FIG. 2 showing the forward end of the nose adapter of the blind bolt fastener installation tool with a blind bolt fastener loaded into said nose adapter.
Figure 5:
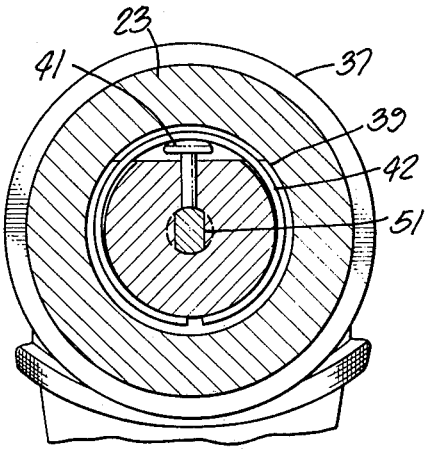
FIG. 5 is a cross-sectional view taken on the line 5—5 of FIG. 2 showing a portion of the stem retrieval wrench adapter of the blind bolt fastener installation tool, including the engagement pin and lock ring of said stem retrieval wrench adapter.
Figure 6:
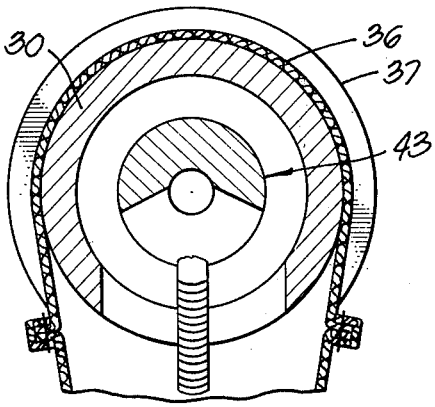
FIG. 6 is a cross-sectional view taken on the line 6—6 of FIG. 2 showing portions of the inner and outer retrieval barrels of the blind bolt fastener installation tool with a severed blind bolt fastener stem falling through the aperture in each of the inner and outer retrieval barrels.
Figure 7:
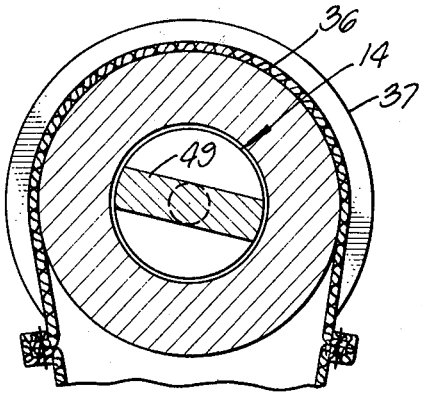
FIG. 7 is a cross-sectional view taken on the line 7—7 of FIG. 2 showing the connection of the nipple portion of the inner retrieval barrel of the blind bolt fastener installation tool with the forward end of the torque-responsive wrenching drive-transmitting assembly thereof.
Figure 2:
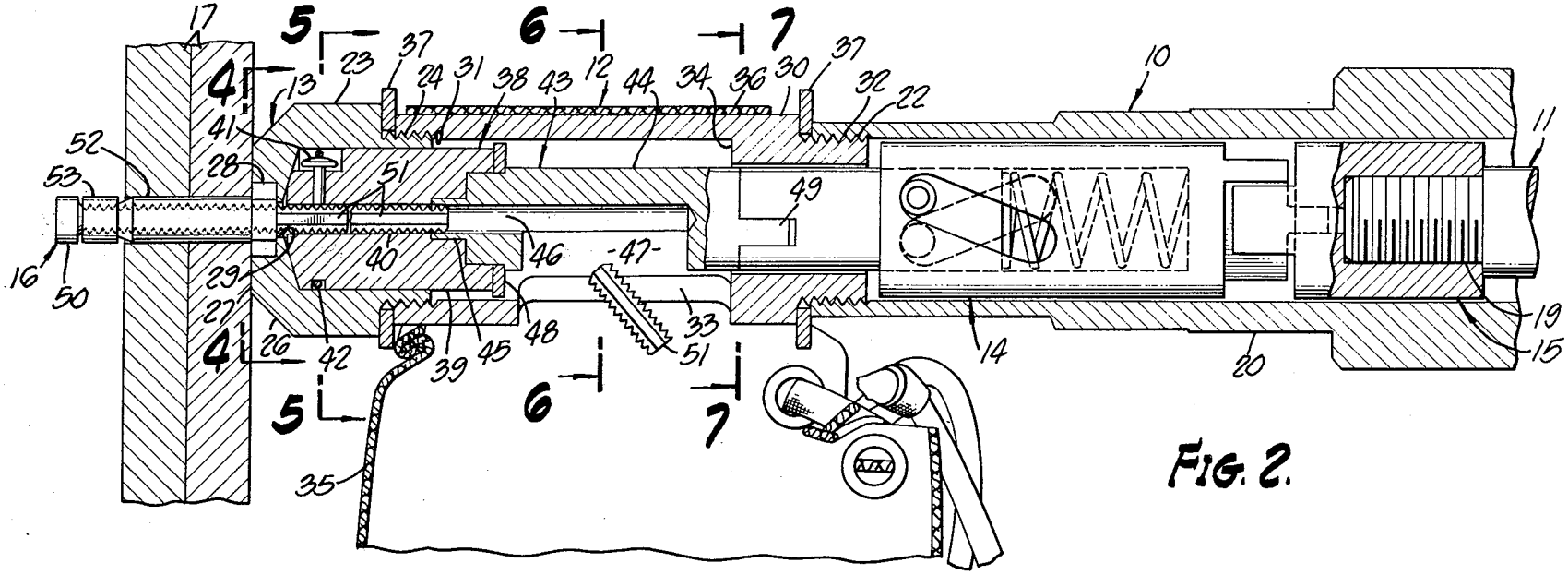
FIG. 2 is an axial sectional view of a portion of the blind bolt fastener installation tool showing portions of the apparatus for retrieving severed blind bolt fastener stems in elevation and their relation to other parts of the installation tool at a starting point of one of a series of blind bolt fastener installation operations.
Figure 3:
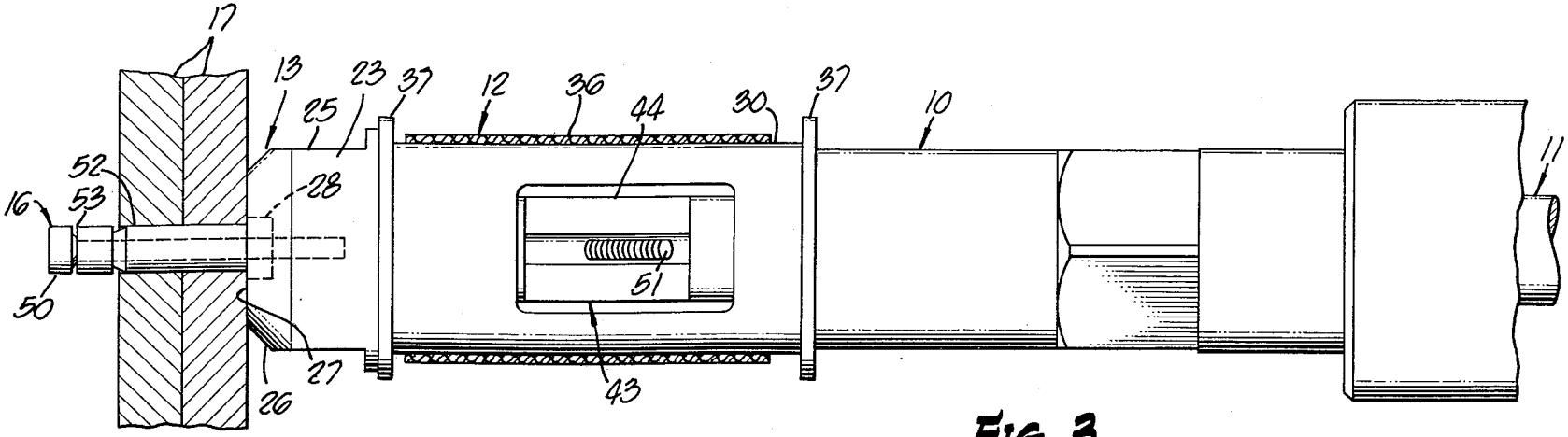
FIG. 3 is a bottom view, partially in section, of a portion of the blind bolt fastener installation tool at the starting point of a blind bolt fastener installation operation.

Depicted in the drawings is a blind bolt fastener installation tool of an in-line assembly type, exemplary of one embodiment of the instant invention. In general, this tool includes a barrel 10 attached to and projecting forwardly from a housing section, generally designated 18 (see FIG. 1), encasing a driving mechanism, generally designated 11 (fragmentarily shown in FIGS. 2 and 3); an apparatus for retrieving severed blind bolt fastener stems (stem retrieval apparatus), generally designated 12, mounted to the forward end of barrel 10; a nut-holding nose adapter member, generally designated 13, mounted to the forward end of the stem retrieval apparatus 12 and projecting forwardly therefrom; and a torque-responsive wrenching drive-transmitting assembly, generally designated 14 (optional and described in detail in the above-mentioned patent of Ben C. Keasler, U.S. Pat. No. 3,128,655, the specification of which is incorporated herein by reference), adapted to receive rotary drive from the drive shaft of the driving mechanism 11 through a dog clutch unit 15. The tool is shown in FIGS. 2 and 3 with loaded blind bolt fastener 16 projecting through aligned holes in adjacent sheets of work 17 to be secured together with the fastener.

The tool may utilize any conventional driving mechanism, such as an air motor or other type of motor encased in housing 18 to the forward end of which the barrel 10 is attached, as mentioned above. Such housing 18 may embody a suitable pistol grip, as depicted in FIG. 1, or other means for holding and manipulating the tool. As shown in FIG. 2, the driving mechanism has a drive shaft terminating in the configuration of an externally threaded spindle 19.

DETAILED DESCRIPTION

Barrel 10 comprises a generally cylindrical body portion 20 having at its rear end 21 (see FIG. 1) a suitable coupling portion (not shown), e.g., threads or other attaching means for a coupling connection to the forward end of the housing 18 for the driving mechanism 11, and terminating at its forward end with internal threads 22 to receive and connect the stem retrieval apparatus 12.

Nose adapter 13 comprises a body in the form of a cylindrical sleeve 23, having at its rearward end an externally threaded nipple 24 for receipt by the stem retrieval apparatus 12 and connection thereto, and having external wrenching flats 25 to facilitate assembly and disassembly with the stem retrieval apparatus 12. Nose adapter 13 has at its forward end a tapered nose 26, terminating in a flat circular surface 27 provided with suitable wrenching jaws 28 for receiving and preventing the rotation of the nut portion of a blind bolt fastener upon its being loaded into the installation tool. A cylindrical passageway 29, substantially concentric with the cylindrical sleeve 23, is located rearwardly of the wrenching jaws 28 for receipt and passage of the stem portion of a blind bolt fastener therethrough upon its being loaded into the tool. A left-hand thread on the nipple 24 and in the portion of the stem retrieval apparatus 12 by which the nipple 24 is received provides for a tight coupling connection between the nose adapter 13 and the stem retrieval apparatus 12.

The stem retrieval apparatus 12 is comprised of directing means for directing a severed stem into retaining means as will be discussed below. In this embodiment of the present invention, these directing means include a rotatable member positioned substantially within a housing. The rotatable member will be described subsequently. The housing is in the form of a generally cylindrical outer retrieval barrel 30, having at its forward end internal threads 31 for receipt of nipple 24 and connection with the nose adapter 13, while having at its rearward end an externally threaded nipple 32 for receipt by the internal threads 22 at the forward end of barrel 10 and connection therewith. The outer retrieval barrel 30 also has an aperture 33 in its lower wall for the passage of severed blind bolt fastener stems therethrough. In addition, the outer retrieval barrel 30 has a reduced throat 34 at its rearward end to prohibit the passage of severed blind bolt fastener stems thereby.

The stem retrieval apparatus 12 is further comprised of retaining means for receiving and retaining severed stems passing through said directing means. These retaining means include an enclosure and means for positioning the enclosure adjacent the directing means mentioned above. The enclosure is in the form of a vinyl bag 35, the mouth of which is held directly opposite and securely around aperture 33 such that all severed stem pass into the vinyl bag 35 and are retained therein.

The means for positioning said enclosure adjacent the directing means includes a vinyl strip 36. This vinyl strip 36 holds the mouth of the vinyl bag 35 opposite the aperture 33 by fitting over and partially around the outer retrieval barrel 30. The strip 36 is kept from moving forwardly or rearwardly by washers 37 which have a larger diameter than the outer diameter of the outer retrieval barrel 30 and are positioned between the nose adapter 13 and the outer retrieval barrel 30 and between the barrel 10 and the outer retrieval barrel 30. It is noted that any suitable retaining means, readily apparent to those versed in the art, might be employed for the retrieval of severed stems rather than ones including the vinyl bag 35 and the vinyl strip 36.

Also comprised in the stem retrieval apparatus 12 are restraining means for restraining a severed stem from falling from the installation tool until disengaged from the restraining means into the directing means. These restraining means include a rotatable member, herein called a stem retrieval wrench adapter 38, having a cylindrical body portion 39, the forward end of which bears against the rearwardly facing inner wall of the nose adapter 13, said inner wall being directly opposite the flat circular surface 27 of the nose adapter 13. The outer cylindrical wall of the stem retrieval wrench adapter 38, for a substantial portion of its length, bears against the inner cylindrical wall of the nose adapter 13. This bearing configuration actually supports the parts which are serially connected and housed within the outer retrieval barrel 30 and housing 10 between the driving mechanism 11 and nose adapter 13, but are not otherwise supported therein, to facilitate their rotary movement in the process of installing a blind bolt fastener. The stem retrieval wrench adapter 38 also has a passageway 40 therethrough, extending substantially along the axis of rotation of the wrench adapter 38. The forward end of this passageway 40 aligns with the cylindrical passageway 29 in the nose adapter 13. However, the initial forward portion of passageway 40 has a cross-sectional configuration substantially the same as that of a blind bolt fastener stem to facilitate the receipt and turning of the stem during the installation of the fastener and the retention of the stem after its severance from the fastener. Passageway 40 has a circular cross-section for approximately the last half of its length to facilitate movement of severed stems therethrough.

The restraining means also include means for engaging a severed stem to keep the severed stem from falling from the installation tool until disengaged from said engaging means. These engaging means are in the form of an engagement pin 41, located at the forward end of the stem retrieval wrench adapter 38, the stem of which is received by a bore through the cylindrical body portion 39 of the stem retrieval wrench adapter 38, said stem being slightly longer than said bore, said bore being substantially perpendicular to the axis of rotation of the wrench adapter 38 and connecting the passageway 40 with a slot in the outside wall of the cylindrical body portion 39, the slot accommodating the head of the engagement pin 41.

In addition, the restraining means further include means to urge the engaging means into engagement with a severed stem. These urging means are in the form of a lock ring 42, which substantially circumscribes the cylindrical body portion 39 of the stem retrieval wrench adapter 38, passing over the head of the engagement pin 41 and being received by a partially circumferential groove in the cylindrical body portion 39. The groove and slot in the body portion 39 allow the wrench adapter 38 to freely rotate within the nose adapter 13 without the head of the engagement pin 41 or the lock ring 42 touching the interior walls of the cylindrical sleeve 23 of the nose adapter 13, while the groove in the body portion 39 also restricts rearwardly or forwardly movement of the lock ring 42, thereby maintaining the lock ring 42 in contact with the head of the engagement pin 41. This contact is maintained so that the engagement pin 41 will engage the stem of a blind bolt fastener as it is loaded into the installation tool and received into the passageway 40 of the wrench adapter 38.

Pin 41 remains in engagement with the stem during the installation of the fasteners, riding over the initially contacted row of threads on the stem as the stem moves rearwardly in passageway 40 due to the rotation of the nose adapter 13. Furthermore, pin 41 remains in engagement with the stem after it has been severed at the end of the fastener installation process, keeping the severed stem from rearwardly or forwardly movement in the passageway 40 (especially forwardly movement so that the stem will not fall from the installation tool) until the severed stem is disengaged in the rearwardly direction by the stem of the next loaded blind bolt fastener to ultimately be deposited in the vinyl bag 35, as will be explained below.

As mentioned above, the directing means of the stem retrieval apparatus include a rotatable member positioned substantially within a housing, which was described above. This rotatable member, called an inner retrieval barrel 43 herein, is substantially concentrically positioned inside the outer retrieval barrel 30 and has a generally cylindrical body portion 44 with a nipple portion 45 at its forward end, said nipple portion 45 being received by a slot in the rearward end of the stem retrieval wrench adapter 38. The inner retrieval barrel 43 also has a passageway 46 of circular cross-section, substantially along its axis of rotation, which aligns with the passageway 40 of the stem retrieval wrench adapter 38 for the passage of severed stems from the wrench adapter 38 through the inner retrieval barrel 43. The inner retrieval barrel passageway 46 discharges through an aperture 47 in the cylindrical wall of the body portion 44 of the inner retrieval barrel 43 into the area between the inner wall of the outer retrieval barrel 30 and the outer wall of the inner retrieval barrel 43. The inner retrieval barrel aperture 47 is aligned with the outer retrieval barrel aperture 33 when the inner retrieval barrel 43 is rotated such that its aperture 47 is facing in the direction of the bag 35. Hence, severed blind bolt fasteners pass through inner retrieval barrel aperture 47, through outer retrieval barrel aperture 33, and into vinyl bag 35 to be retained therein.

To prohibit the forward movement of severed stems within the area between the outer retrieval barrel 30 and the inner retrieval barrel 43, the stem retrieval apparatus 12 includes a washer 48, which has an outer diameter slightly less than the inner diameter of the outer retrieval barrel 30 and is located between the rearward end of the nose adapter 13 and the forward end of the inner retrieval barrel 43.

Finally, the rearward end of the inner retrieval barrel 43 has a nipple portion 49 which is received by a slot in the forward end of the torque-responsive wrenching drive-transmitting assembly 14.

In operation, rotation of the stem retrieval wrench adapter 38, inner retrieval barrel 43, etc., is clockwise as viewed by an operator holding the tool and facing the sheets of work 17. The blind bolt fastener 16 includes a screw 50, having a left-hand thread and flats on a shaft, said shaft having a break-off stem 51 which is broken off from the screw 50 by increase in driving load when the fastener 16 is fully installed. The fastener 16 also includes a nut 52 with a sleeve at its forward end, said sleeve being tapered at its forward end, and a collar 53 which fits loosely around the screw 50 between the head of the screw and the sleeve of nut 52. The nut 52 is threaded onto the screw 50 and the collar 53 is expanded to form a head at the forward or blind end of the fastener by expansion over the sleeve as the screw 50 is drawn rearwardly into the nut 52, the collar 53 being driven by the head of the screw 50. The stem retrieval wrench adapter 38 receives the stem 51 with suitable wrenching faces in the forward portion of the passageway 40, in this case with wrenching flats, which engage the flats of the stem 51. The nut 52 is held stationary by means of a suitable wrenching connection between the wrenching jaws 28 of the nose adapter 13 and the sides of the nut 52 at its rearward end. As the stem 51 is held in this manner and turned by rotation of the stem retrieval wrench adapter, it is drawn rearwardly until a point is reached when the resistance to the driving of the collar 53 over the tapered sleeve of nut 52 sharply increases due to substantial engagement of the collar 53 with the forward sheet of work 17 and compression of the collar 53. Consequently, the stem 51 is twisted and broken off at a predetermined point, completing the installation of the fastener.

As has been mentioned previously, the severed stem 51 is held in place in the passageway 40 by the engagement pin 41 until it is disengaged in the rearwardly direction by the stem of the next loaded blind bolt fastener. Once disengaged, severed stem 51 is moved, either by gravitational forces or the urging of subsequently loaded and severed stems, through the remainder of the stem retrieval wrench adapter passageway 40 and through the inner retrieval barrel passageway 46 until it reaches the inner retrieval barrel aperture 47. The severed stem 51 then falls through this aperture 47 when it is rotated in a downwardly direction, through the outer retrieval barrel aperture 33, into the vinyl bag 35 and is retained therein.

Having fully described my invention it is to be understood that I am not limited to the details herein set forth, but that my invention is of the full scope of the appended claims.

I claim:

1. An apparatus for retrieving the severed stems of blind bolt fasteners to be used in conjunction with a blind bolt fastener installation tool, which comprises:
   a. means for retaining a plurality of severed stems;
   b. means for directing a severed stem into said retaining means;
   c. means for restraining a severed stem from falling from the installation tool until disengaged from said restraining means into said directing means, said restraining means being in communication with said retaining means, said directing means comprises:
   d. a housing operably connected to the installation tool said housing being further defined as having a first aperture adapted to pass severed stems therethrough; and
   e. a rotatable member positioned substantially within said housing, said rotatable member having a passageway therethrough substantially along its axis of rotation for receiving severed stems, said rotatable member being further defined as having a second aperture adapted to pass severed stems therethrough.

2. The apparatus as claimed in claim 1, wherein said restraining means comprises:
   a. a rotatable member having a passageway therethrough substantially along its axis of rotation, said passageway adapted to receive the stem of a blind bolt fastener as it is loaded into the installation tool;
   b. means for engaging a severed stem to hold the severed stem within said passageway until disengaged from said engaging means; and
   c. means to urge said engaging means into engagement with a severed stem.

3. An apparatus for retrieving the severed stems of blind bolt fasteners to be used in conjunction with a blind bolt fastener installation tool, which comprises:
   a. a first rotatable member having a first passageway therethrough substantially along its axis of rotation, said first passageway adapted to receive the stem of a blind bolt fastener as it is loaded into the installation tool;
   b. means for engaging a severed stem to hold the severed stem within said first passageway until disengaged from said engagement means;
   c. means to urge said engaging means into engagement with a severed stem;
   d. a second rotatable member having a second passageway therethrough substantially along its axis of rotation for receiving a severed stem, said second passageway communicating with said first passageway, said second rotatable member being further defined as having a first aperture adapted to pass severed stems therethrough;
   e. a housing operably connected to the installation tool, said second rotatable member being positioned substantially within said housing, said housing being further defined as having a second aperture adapted to pass severed stems therethrough;
   f. an enclosure for receiving and retaining severed stems; and g. means for positioning said enclosure adjacent said second aperture for receiving and retaining severed stems passing through said second aperture.

4. An apparatus for retrieving the severed stem of blind bolt fasteners to be used in conjunction with a blind bolt fastener installation tool, said installation tool having a barrel, a drive means for turning the stem of a blind bolt fastener, and a nose adapter for receiving the stem of the fastener and holding the body of the fastener against rotation during installation of the fastener, which comprises:

a. a first rotatable cylindrical member having a first passageway therethrough substantially along its axis of rotation, said first passageway adapted to receive the stem of a blind bolt fastener as it is loaded into the installation tool, said first rotatable cylindrical member bearing against the nose adapter of the tool;

b. engagement means adapted to hold a severed stem within said first passageway until disengaged from said engagement means;

c. biasing means to urge said engagement means into engagement with a severed stem;

d. a second rotatable cylindrical member having a second passageway therethrough substantially along its axis of rotation for receiving a severed stem, said second passageway being substantially aligned with said first passageway and communicating therewith, one end of said second rotatable member being connected to the end of said first rotatable cylindrical member not bearing against the nose adapter of the tool and the other end of said second rotatable cylindrical member being connected to the drive means of the tool, said second rotatable cylindrical member being further defined as having a first aperture adapted to pass severed stems therethrough;

e. a cylindrical housing, one end of said housing being attached to the nose adapter of the installation tool with the other end of said housing being attached to the barrel of the tool, said second rotatable member being approximately concentrically positioned substantially within said housing, said housing being further defined as having a second aperture adapted to pass severed stems therethrough;

f. an enclosure for receiving and retaining severed stems; and g. means for positioning said enclosure adjacent said second aperture for receiving and retaining severed stems passing through said second aperture.

5. An improved blind bolt fastener installation tool of the type in which the stem of a blind bolt fastener is severed from the rest of the fastener during the installation of the fastener, wherein the improvement comprises:

a. a first rotatable member having a first passageway therethrough substantially along its axis of rotation, said first passageway adapted to receive the stem of a blind bolt fastener as it is loaded into the installation tool;

b. means for engaging a severed stem to hold the severed stem within said first passageway until disengaged from said engaging means;

c. means to urge said engaging means into engagement with a severed stem;

d. a second rotatable member having a second passageway therethrough substantially along its axis of rotation for receiving a severed stem, said second passageway communicating with said first passageway, said second rotatable member being further defined as having a first aperture adapted to pass severed stems therethrough;

e. a housing operably connected to the installation tool, said second rotatable member being positioned substantially within said housing, said housing being further defined as having a second aperture adapted to pass severed stems therethrough;

f. an enclosure for receiving and retaining severed stems; and g. means for positioning said enclosure adjacent said second aperture for receiving and retaining severed stems passing through said second aperture.

6. An improved blind bolt fastener installation tool of the type having a barrel, a drive means for turning the stem of a blind bolt fastener, and a nose adapter for receiving the stem of a blind bolt fastener and holding the body of the fastener against rotation during installation of the fastener, which comprises:

a. a first rotatable cylindrical member having a first passageway therethrough substantially along its axis of rotation, said first passageway adapted to receive the stem of a blind bolt fastener as it is loaded into the installation tool, said first rotatable cylindrical member bearing against the nose adapter of the tool;

b. engagement means adapted to hold a severed stem within said first passageway until disengaged from said engagement means;

c. biasing means to urge said engagement means into engagement with a severed stem;

d. a second rotatable cylindrical member having a second passageway therethrough substantially along its axis of rotation for receiving a severed stem, said second passageway being substantially aligned with said first passageway and communicating therewith, one end of said second rotatable member being connected to the end of said first rotatable cylindrical member not bearing against the nose adapter of the tool and the other end of said second rotatable cylindrical member being connected to the drive means of the tool, said second rotatable cylindrical member being further defined as having a first aperture adapted to pass severed stems therethrough;

e. a cylindrical housing, one end of said housing being attached to the nose adapter of the installation tool with the other end of said housing being attached to the barrel of the tool, said second rotatable member being approximately concentrically positioned substantially within said housing, said housing being further defined as having a second aperture adapted to pass severed stems therethrough;

f. an enclosure for receiving and retaining severed stems; and g. means for positioning said enclosure adjacent said second aperture for receiving and retaining severed stems passing through said second aperture.

* * * * *

UNITED STATES PATENT AND TRADEMARK OFFICE

CERTIFICATE OF CORRECTION

PATENT NO. : 4,000,668

DATED : January 4, 1977

INVENTOR(S) : BEN C. KEASLER

It is certified that error appears in the above-identified patent and that said Letters Patent are hereby corrected as shown below:

Assignee: Lok-Fast, Inc.

Newport Beach, California

Signed and Sealed this

Twelfth Day of April 1977

[SEAL]

*Attest:*

RUTH C. MASON
*Attesting Officer*

C. MARSHALL DANN
*Commissioner of Patents and Trademarks*